United States Patent [19]

Nickum

[11] 4,269,093

[45] May 26, 1981

[54] ROTARY DIE CUTTING MACHINE

[75] Inventor: Robert H. Nickum, Cincinnati, Ohio

[73] Assignee: Cincinnnati Rotary Press Company, Cincinnati, Ohio

[21] Appl. No.: 24,978

[22] Filed: Mar. 29, 1979

[51] Int. Cl.[3] ..... B31B 1/20

[52] U.S. Cl. ..... 83/174; 83/347; 83/417; 493/355; 271/171; 271/267; 493/370

[58] Field of Search ..... 83/346, 347, 417, 174, 83/863, 887; 93/58.1, 58.2; 271/171, 267, 268, 269, 144, 131

[56] References Cited

U.S. PATENT DOCUMENTS

| | | | |
|---|---|---|---|
| 1,235,293 | 7/1917 | Daven | 93/58.2 R |
| 1,353,086 | 9/1920 | Swift | 93/58.2 R |
| 2,333,592 | 11/1943 | Sieg | 83/347 X |
| 2,776,610 | 1/1957 | Roselius | 93/58.2 R |
| 3,061,303 | 10/1962 | Glaser et al. | 271/240 X |

*Primary Examiner*—J. M. Meister

*Attorney, Agent, or Firm*—Frost & Jacobs

[57] ABSTRACT

A rotary die cutting and scoring machine including a free wheeling resiliently covered anvil roll, an adjustable pusher having a velocity profile insuring that the velocity of the leading edge of the fed sheets matches the peripheral speed of the cutting roll, guides for guiding the side edges of the fed sheets maintaining their guide services parallel to the direction of feed and a reciprocating cutting tool for removing a selected portion of the resilient coating on said anvil roll to produce a fresh anvil surface. The machine also includes a support plate located on the reciprocating pusher to insure accurate feeding of warped sheets.

15 Claims, 16 Drawing Figures

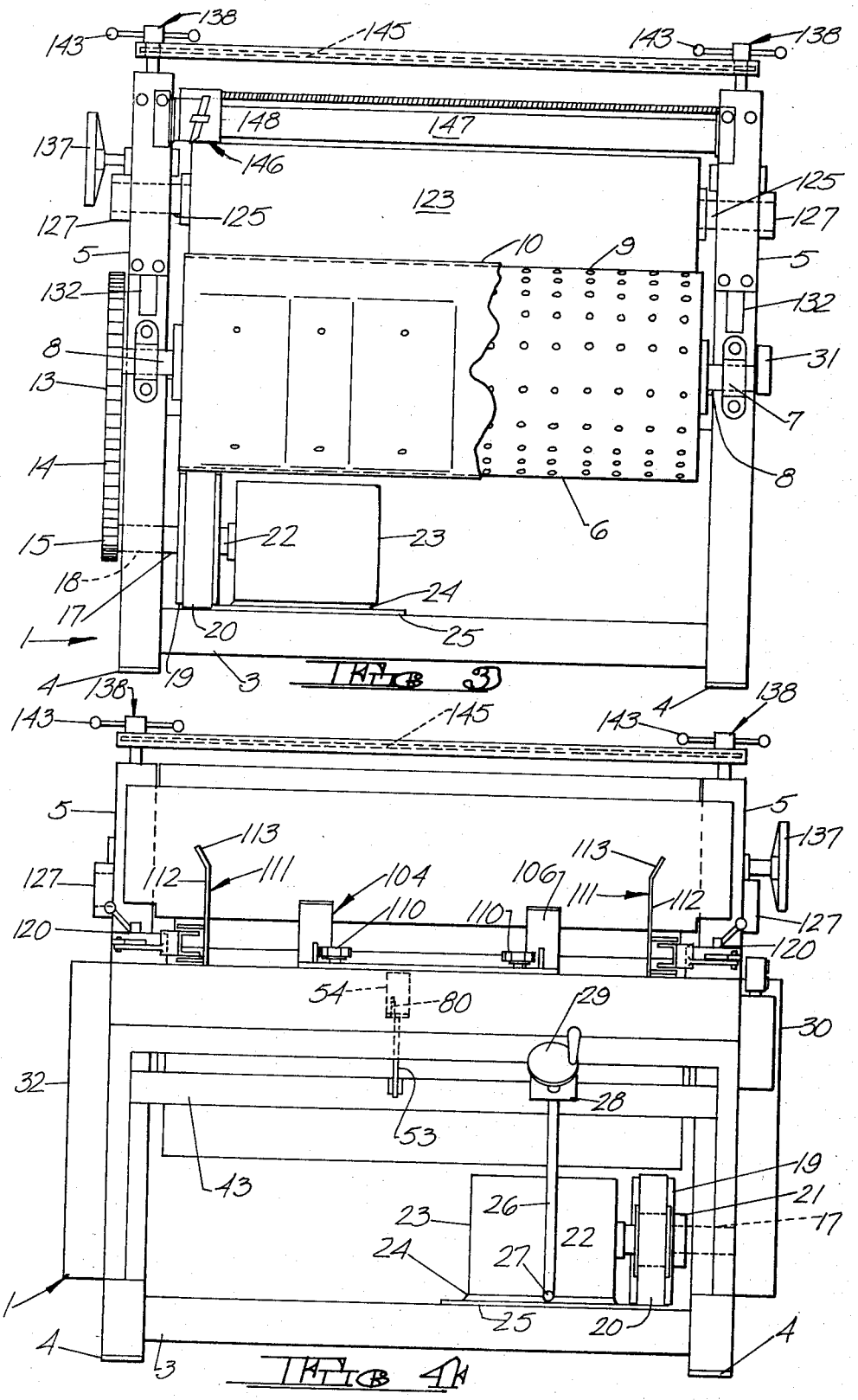
THIS 3
THIS 4

ROTARY DIE CUTTING MACHINE

BRIEF SUMMARY OF THE INVENTION

In situations where high volume production of paperboard or cardboard cutting or scoring is required, it has become commonplace to use rotary die cutter machines. Such machines generally employ a cylindrical cutter roller rotating at relatively high speed which mounts a plurality of upstanding rule-like cutting dies accurately arranged in the desired pattern of cutting or scoring to be impressed upon the paperboard or cardboard blanks. The rotating cutter roll is configured to bear against a cylindrical anvil or back-up roll which provides a cutting surface for the rule-like dies.

A stack of sheet blanks is supported adjacent the counter-rotating rolls, with the bottommost sheet fed between the rolls by means of a pusher or kicker. The forwardmost edge of the sheet is drawn through the roll nip such that the dies produce the desired cutting or scoring impression on the sheet. The processed sheets are forced outwardly through the rolls where additional operations such as stripping, stacking or the like may take place.

With the cost of paperboard or cardboard blank material at a high level, close attention must be paid to eliminating waste and improving the quality of the product produced by such rotary die cutting machines. For example, it has been found that slight inaccuracies in placement of the die on the die cutting roll can result in excessive waste material at the forward edge of the blank. Although means have been proposed for compensating for these inaccuracies, such operations generally involve complicated adjustment procedures and machine downtime. Similar problems have been experienced in the form of misfeeds which may occur if the board is warped or otherwise deformed. It has also been found that failure of the pusher mechanism to match the blank velocity to the peripheral speed of the cutter roll can result in tearing or breaking of the blank, and in severe cases damage to the rule-like dies themselves.

Further problems have been experienced in die cutting machines which use a back-up roll covered with a resilient mat. After repeated cutting operations, the surface of the back-up roll may become permanently scarred or defaced, such that the rule-like dies no longer make a true cut or score line. Consequently, the entire back-up roll must be removed for replacement or resurfacing. Although mechanisms have been proposed for automatically oscillating the back-up roll to postpone indentations caused by repetitive cutting of the dies, such mechanisms have often been unnecessarily complex and unwieldy.

The rotary die cutting machine of the present invention overcomes limitations of known die cutting and scoring machines by providing a simplified feed mechanism lacking critical assembly tolerances which insures reliable blank feed and die registration with severely warped or otherwise inferior cardboard or paperboard blank material. Furthermore, the resilient back-up roll is displaceable axially to spread die impressions resulting from extended use over the entire surface of the back-up roll. In a preferred embodiment, the drive mechanism for the pusher is arranged to match the velocity of the material blank with the peripheral speed of the die cutting roll without excessive acceleration of the blank which might cause it to buckle. Other features of the invention will become apparent from the detailed description which follows.

In particular, the rotary die cutting machine of the present invention comprises a frame having a pair of spaced vertical support members rotatably supporting an elongated cylindrical die cutting roll bearing the desired pattern of upstanding rule-like dies. The die cutting roll is driven from a suitable electric drive motor through a belt driven variable speed transmission which permits the feed rate to be adjusted for various types and thicknesses of material.

A second smaller anvil or back-up roll is rotatably supported above the die cutting roll. A parallel pressure downfeed is provided to adjust the back-up roll vertically so that the outer surface of the back-up roll abuts and is driven by the outermost edges of the rule-like dies. This adjustment also provides the necessary pressure to insure that the die properly cuts or scores the blank material. An axial adjustment is also provided with the back-up roll which permits this roll to be moved horizontally so as to spread impressions made by the dies over the entire surface of the roll. Both the parallel pressure downfeed and axial adjustments can be made rapidly by an unskilled operator while the machine is operating.

The rearmost upper surface of the rotary die cutting machine forms a hopper-like platform for supporting a stack of material blanks which are repetitively fed between the back-up and die cutting rolls by a reciprocating pusher or kicker. In a preferred embodiment, the pusher of the present invention comprises a wheeled carriage bearing a resiliently mounted angled plate which supports and guides the bottommost blank in the stack of blanks. The wheeled carriage is moved horizontally by means of an endless cable connected to an oscillating arcuate drive member driven from one end of the die cutting roll by means of a crank and pitman arrangement. As will be explained in more detail hereinafter, the crank and pitman is configured to produce a non-linear velocity in the pusher such that the velocity of the material blank increases slowly until it matches the peripheral speed of the cutting roll. The pitman and cranks may also be adjusted to compensate for slight misalignments between the dies and the die cutting roll. A further adjustment is provided for the support plate upon which the wheeled carriage travels to set the distance between the forwardmost edge of the material blank and the forwardmost die cut or score line to minimize material waste and insure that the initial cut or score line is within the margin of the material blank. In one embodiment of the invention, the support plate affixed to the wheeled carriage upon which the bottommost material blank rests is pivotally connected to the carriage so as to conform to the shape of warped or otherwise non-planar blanks, thereby preventing misfeeds and jams which lead to machine downtime and may in severe cases damage the rule-like dies or supports.

To further insure accurate feed of the material blanks the sides of the hopper-like support platform are provided with adjustable pantograph-like side guide members which can be individually adjusted to various material widths. The side guides automatically present surfaces parallel to the direction of feed of the material blanks under all conditions which insures reliable registration of the cutting or scoring pattern with the material blank.

After a period of use, the other surface of the resilient covering of the back-up roll may become cut or scored, resulting in unreliable die cutting or scoring. In such cases, the back-up roll is commonly removed from the machine and replaced or resurfaced with a new resilient coating. In the present invention, however, a cutter stripper consisting of a cutting tool is positioned above the back-up roll and mounted for movement in a direction parallel to the rotational axis of the back-up roll. When the surface of the back-up roll becomes sufficiently worn, the cutting tool is brought into contact with the outer surface of the back-up roll while the roll is being rotated, and the cutter stripper drawn across the surface of the roll to remove a portion of the outer resilient covering, thus exposing a fresh anvil-like surface. In this way, full use is obtained from each back-up roll, and excessive downtime of the machine is avoided.

BRIEF DESCRIPTION OF THE DRAWING

FIG. 3 is a partially cutaway front elevation view of the rotary die cutting machine of the present invention with the protective side covers removed.

FIG. 4 is a rear elevation view of the rotary die cutting machine in the present invention.

DETAILED DESCRIPTION

Figure 1:
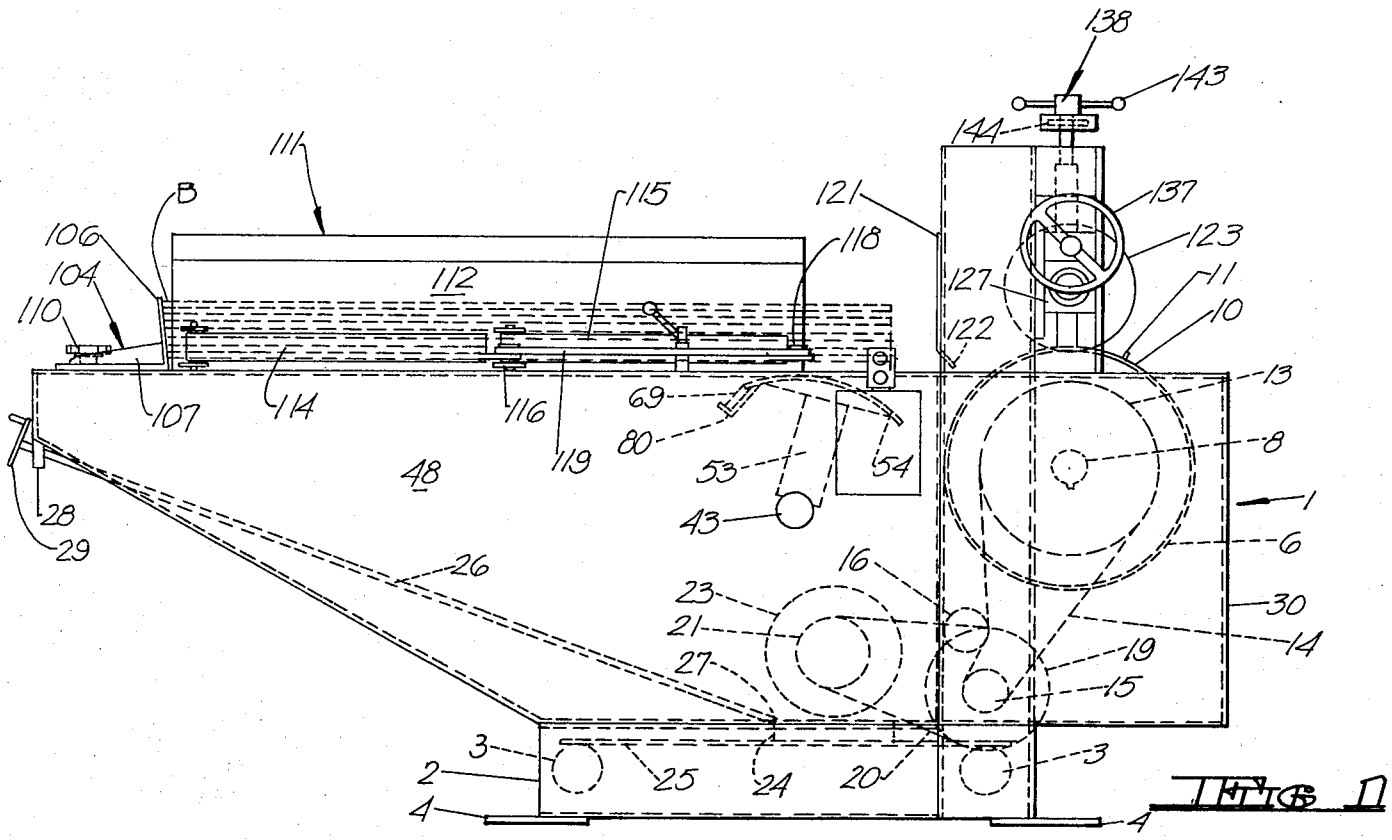
FIG. 1 is a side elevation view of the rotary die cutting machine of the present invention.
Figure 2:
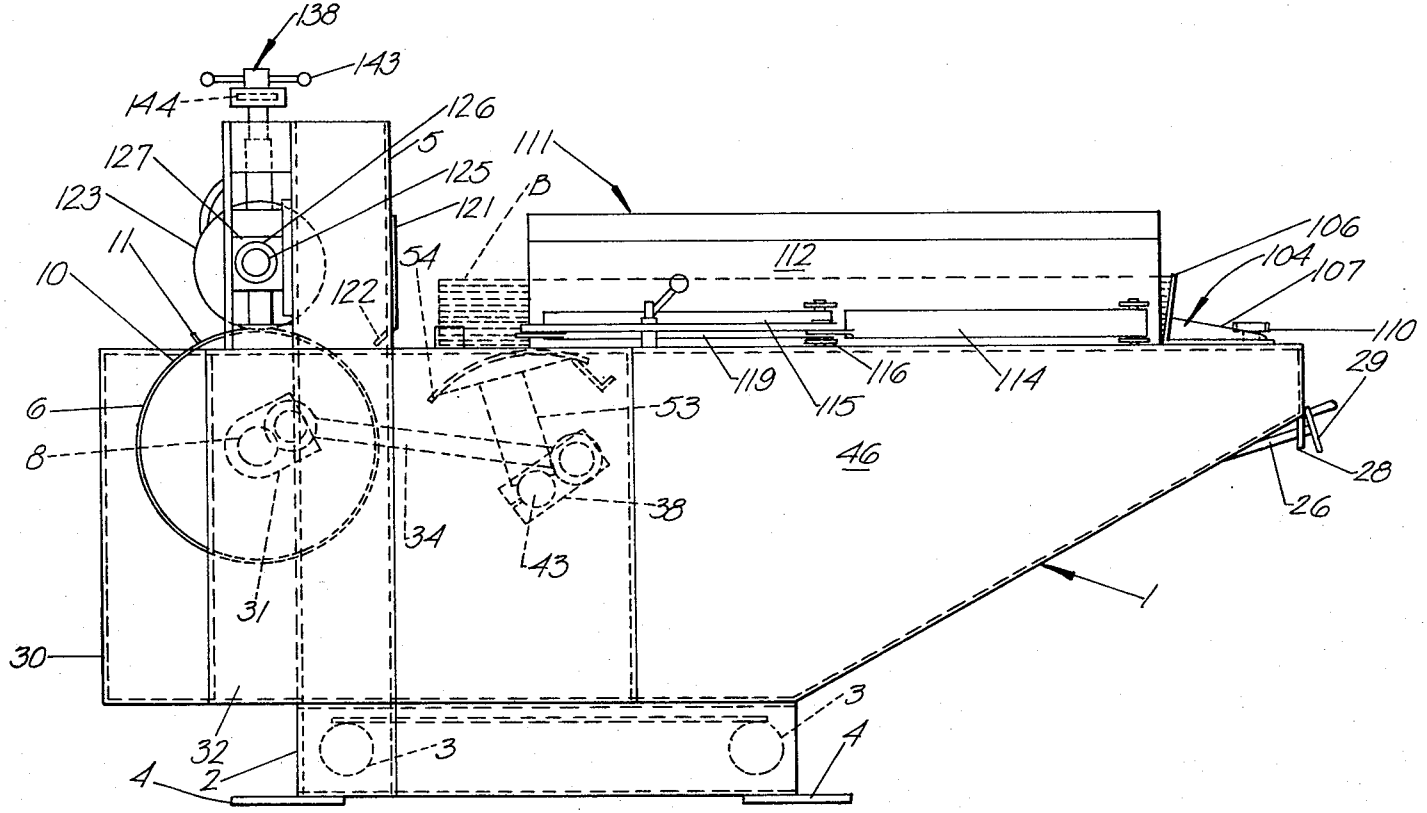
FIG. 2 is a side elevation view illustrating the opposite side of the rotary die cutting machine shown in FIG. 1.

As illustrated in FIG. 1–FIG. 5, the rotary die cutting machine of the present invention, shown generally at 1, is supported by a pair of spaced horizontal frame members 2 connected by a pair of transversely extending tubular members 3 which form a stable platform upon which the remainder of the machine rests. Further stability, as well as means for attaching the machine to a floor or the like, is provided by legs 4 extending outwardly from the corners of frame members 2. A vertical frame member 5 is attached at its lower end to the forward end of each lower horizontal frame member 2. Cylindrical die cutting roll 6 is rotatably mounted between vertical frame members 5 by means of bearings 7 supporting the ends of die cutting roll shafts 8, as can best be seen in FIG. 3. In general, die cutting roll 6 is constructed of steel or the like, and contains a plurality of spaced threaded holes, one of which is shown at 9 in FIG. 3. Die cutting roll 6 is provided with a semi-cylindrical support base 10, which may be constructed of wood, and which contains a number of outwardly projecting metallic die cutting or scoring blades arranged in the desired pattern, one of which is shown at 11. Support base 10 is secured to die cutting roll 6 by means of threaded fasteners 12 passing through support base 10 into the threaded holes 9. As is well known in the art, a substantial degree of skill is required in the fabrication of support base 10 and associated rule-like dies 11 in order to insure accurate registration of the cutting or scoring pattern on the material blanks. As noted hereinabove, misalignment of the dies may result in excessive waste material, or may result in the cutting or scoring pattern missing the leading edge of the material blanks.

As best shown in FIG. 1, a toothed sprocket wheel 13 is non-rotatably secured to the driven end of shaft 8 of die cutting roll 6. Sprocket wheel 13 is engaged by drive chain 14 which is driven from a smaller sprocket 15 journaled below roll 6. A second sprocket wheel 16 positioned above wheel 15 and slightly to the rear thereof engages the outer surface of chain 14 and acts as an idler and means to adjust the chain tension.

Sprocket wheel 15 is non-rotatably secured to shaft 17 which is journaled in vertical frame member 5 as at 18, and non-rotatably supports sheave 19 at its innermost end. Sheave 19 is rotatably driven by drive belt 20 from spring loaded variable pitch sheave 21 which is secured to shaft 22 of electric drive motor 23.

Motor 23 is rigidly affixed to platform 24 which is slidably supported by support platform 25 extending longitudinally between tubular transverse support members 3. As a result of this construction, motor 23 and supporting platform 24 are free to move horizontally in a direction transverse to the axis of rotation of motor 23. One end of rod-like shaft 26 is rotatably secured to the rear edge of slidable platform 24 by a swivel connection or the like as at 27. Shaft 26 extends rearwardly and upwardly, attaching to the rear edge of machine 1 by bushing 28 and terminating in handle 29. A handle 29 and consequently shaft 26 are rotated, movable platform 24 is moved inwardly or outwardly by means not shown to increase or decrease the tension on drive belt 20. As this occurs, motor 23 is moved in a like manner such that the increased tension caused by drive belt 20 against sheave 21 causes the pitch of the sheave to change, and consequently the diameter of the sheave. In this manner, the rotational speed of sheave 19 may be varied, and consequently the rotational speed of die cutting roll 6. For example, as handle 29 is rotated to move motor 23 toward the rear of machine 1, the diameter of sheave 21 becomes smaller, thereby increasing the rotational speed of die cutting roll 6. Conversely, as handle 29 is rotated to move motor 23 forwardly, the diameter of sheave 21 increases, thereby slowing the rotational speed of die cutting roll 6. In this manner, variable feed rates may be obtained by utilizing a fixed speed electric motor 23. The entire drive mechanism and transmission may be observed with greater clarity in FIG. 3 where protective cover 30 has been removed from the side of machine 1. The entire drive train is shown schematically in FIG. 6.

Figures 8, 9, 10, 11:
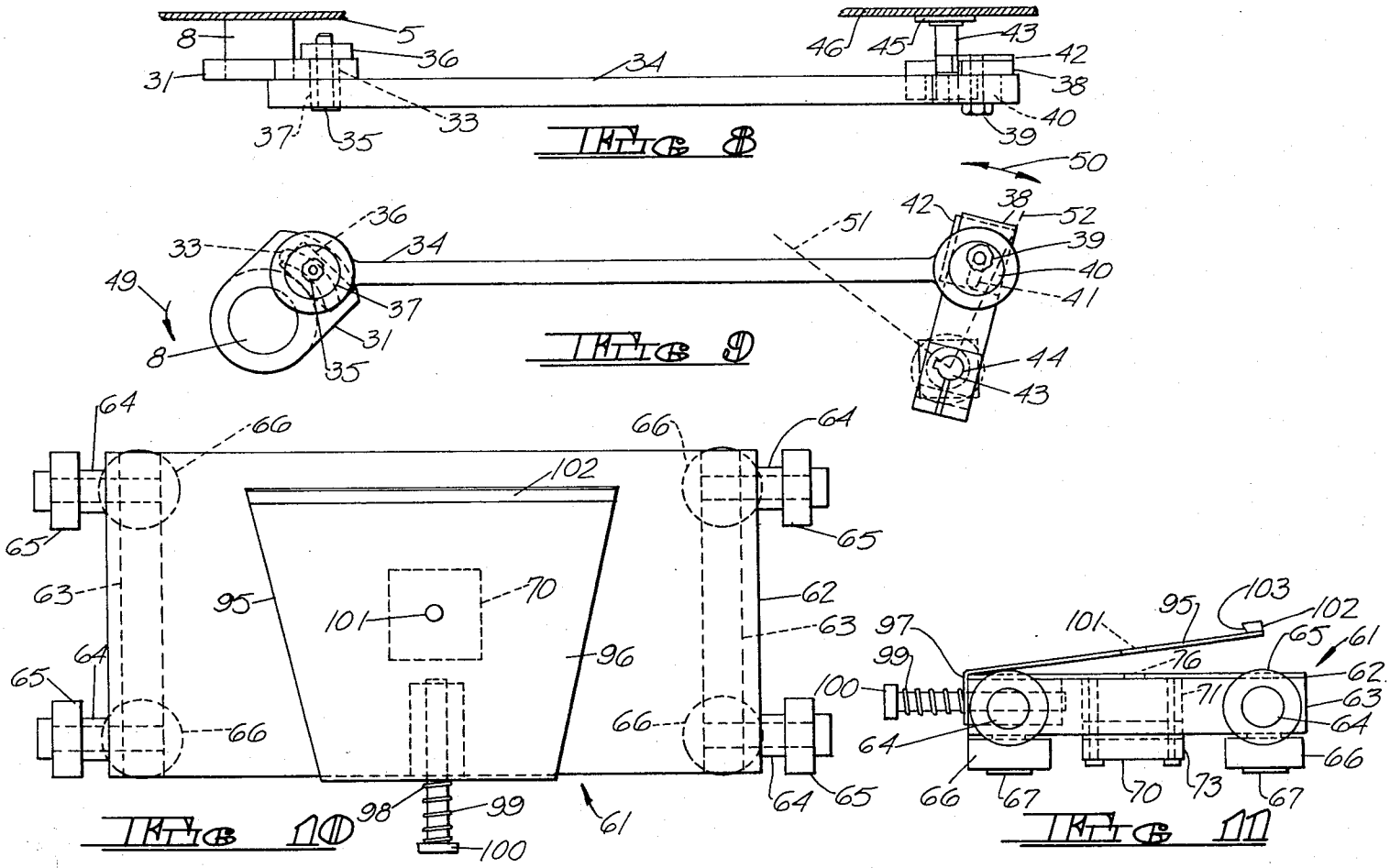
FIG. 8 is a fragmentary enlarged top plan view of the pitman and crank arrangement of the rotary die cutting machine of the present invention, shown partially in cross section.
FIG. 9 is a side elevation view of the pitman and crank arrangement of FIG. 8.
FIG. 10 is a top plan view of the rotary die cutting machine pusher.
FIG. 11 is a side elevation view of the pusher of FIG. 10.

The opposite end of shaft 8 of die cutting roll 6 extends beyond support bearing 7 and is non-rotatably secured to crank arm 31, as can be best seen in FIGS. 8–9 and FIG. 3 where protective cover 32 has been removed for clarity. The outer end of crank arm 31 contains an arcuate slot 33. Pitman arm 34 is rotatably secured to crank arm 31 by means of threaded fastener 35 which passes through a central opening in the end of pitman 34, and is secured at the inside of crank arm 31 by means of threaded block 36 or the like. It will be understood that the central portion of the end of pitman 34 contains a bearing or the like 37 permitting pitman 34 to swivel as shaft 8 and crank arm 39 rotate. Slot 33 provides for adjustment of the pusher characteristics as will be described in more detail hereinafter.

The distal end of pitman 34 is rotatably secured in a similar manner to crank arm 38, such that it is free to rotate about the end of crank arm 38. This attachment may be accomplished by a threaded fastener 39 securing the bearing portion 40 of pitman arm 34 through elongated slot 41 into threaded block 42. Slot 41 provides for adjustment of the pusher movement as will be described in more detail hereinafter. The opposite end of crank arm 38 is non-rotatably secured to rocker arm shaft 43 as at 44. Rocker arm shaft 43 is journaled in support bearing 45 and passes through side wall 46 of machine 1, with the distal end of shaft 43 being similarly journaled in bearing 47 on the opposite side wall 48 of the machine.

Figure 6:
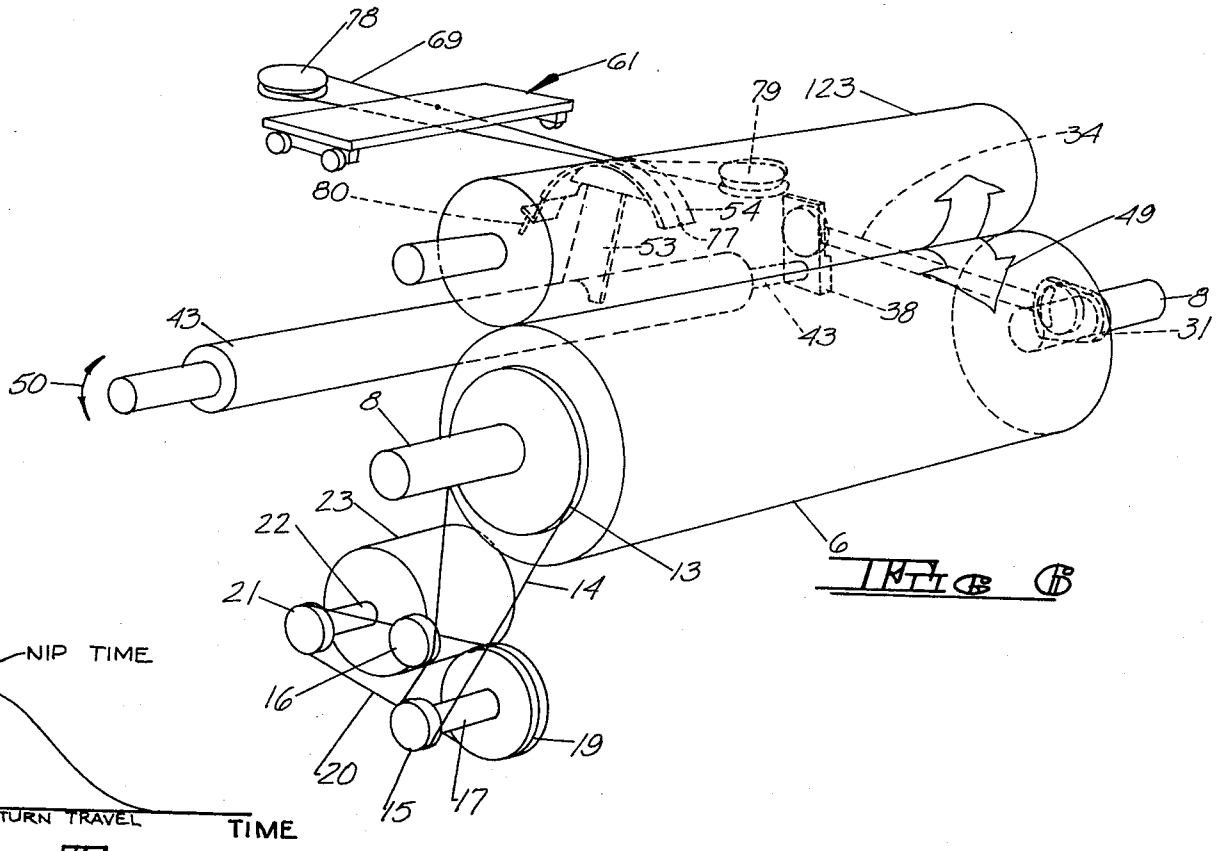
FIG. 6 is a schematic diagram illustrating the drive and feed mechanism of the rotary die cutting machine of the present invention.

It will be observed from FIG. 6 and FIG. 9 that as die cutting roll shaft 8 rotates at a constant speed in the direction of arrow 49, the relative dimensions and angular displacements assigned to crank 31, pitman 34 and crank 38 cause crank 38 and consequently rocker arm shaft 43 to oscillate backward and forward in directions indicated by arrow 50. This oscillating motion is converted to linear motion of the pusher as will be described in more detail hereinafter. In a preferred embodiment, the lengths and position of crank 31, pitman 34 and crank 38 are adjusted such that shaft 43 does not move with a constant angular velocity throughout its arc of travel. For example, in the embodiment illustrated in FIG. 9, crank 38 begins its motion at approximately the position indicated by dashed line 51, corresponding to the rearmost position of the pusher. As die cutting roll shaft 8 continues to rotate, crank 38 is pivoted rearwardly to approximately the rearmost position indicated by dashed line 52. The crank then pivots forwardly to the forward position indicated by dashed line 51. As a result of the geometries involved, the velocity of the crank approaching and leaving the forwardmost position is slower than the velocity of the crank approaching and leaving the rearward position. This action imparts a desired motion to the pusher as will be described in more detail hereinafter. It will be understood by those skilled in the art that the lengths of the cranks and connecting pitman, as well as the angles at which the cranks are attached to their respective shafts, may be changed or modified to produce the desired type of oscillating motion in crank 38.

Positioned at approximately the mid point of rocker arm shaft 43, is an upstanding arm 53, terminating at its upper end in downwardly concave arcuate rocker arm plate 54. This plate is secured to a cable for transmitting the oscillating motion from rocker arm shaft 43 to the pusher.

Figure 15:
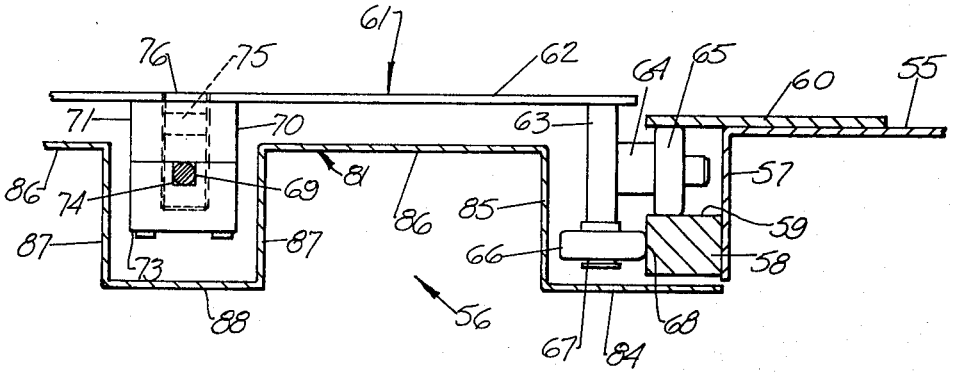
FIG. 15 is a cross sectional view taken along section line 15—15 of FIG. 5.

Positioned above rocker arm plate 54, and forming the rearmost portion of machine 1 is a substantially flat horizontal material support surface 55, supported at its outer edges by side plates 46 and 48, respectively. A longitudinal central opening 56 spans approximately the middle one-third of support surface 55 as shown in FIG. 15. The edges of horizontal support surface 55 adjoining opening 56 are turned downwardly to form flanges 57. A block-like track 58 is attached to the inside surface of each flange 57 and extends longitudinally the length of opening 56. The upper surface 59 of track 58 is provided with a smooth finish to provide a running surface for the guide wheels of the pusher carriage. A flat elongated plate 60 is secured to support surface 55 such that a portion of plate 60 extends over opening 56 in order to further define a guide track for the pusher carriage wheels.

As best shown in FIG. 10–FIG. 11, the pusher, shown generally at 61, comprises a flat plate-like truck 62 having a width slightly less than the distance between guide plates 60. A block-like wheel support 63 depends downwardly from the outside edges of truck 62. Each wheel support 63 bears a pair of spaced outwardly extending horizontal shafts 64, each shaft rotatably mounting a vertically oriented wheel 65. As shown in FIG. 15, wheels 65 are dimensioned to support and guide pusher 61 between track 58 and guide plate 60 for horizontal movement along the feed axis of machine 1.

A second pair of spaced horizontally disposed wheels 66 are rotatably secured to shafts 67 depending downwardly from the lower surface of support 63, such that the rim of wheel 66 makes rolling contact with the innermost surface 68 of track 58, in order to restrain the motion of pusher 61 in a direction transverse to its direction of travel.

Pusher carriage 61 is propelled along the feed axis of machine 1 by means of cable 69 secured to the underside of carriage truck 62 of pusher 61 by means of clamp block 70. Clamp block 70 comprises an upper portion 71 secured to the lower side of truck 62 which contains a threaded aperture 72. A lower movable block 73 contains a horizontal notch or groove 72 slightly smaller than cable 69, and a threaded aperture coaxial with aperture 72 of block 71. When blocks 71 and 73 are mated with cable 69 lying in groove 74, a threaded fastener 75 may be inserted through aperture 76 in plate 62 to threadedly engage the threaded aperture in the blocks to tightly squeeze cable 69 therebetween, and consequently couple pusher 61 to the cable. Pusher 61 can be easily moved to any point along cable 69 to accommodate various lengths of material blanks by merely loosening threaded fastener 75.

Figure 5:
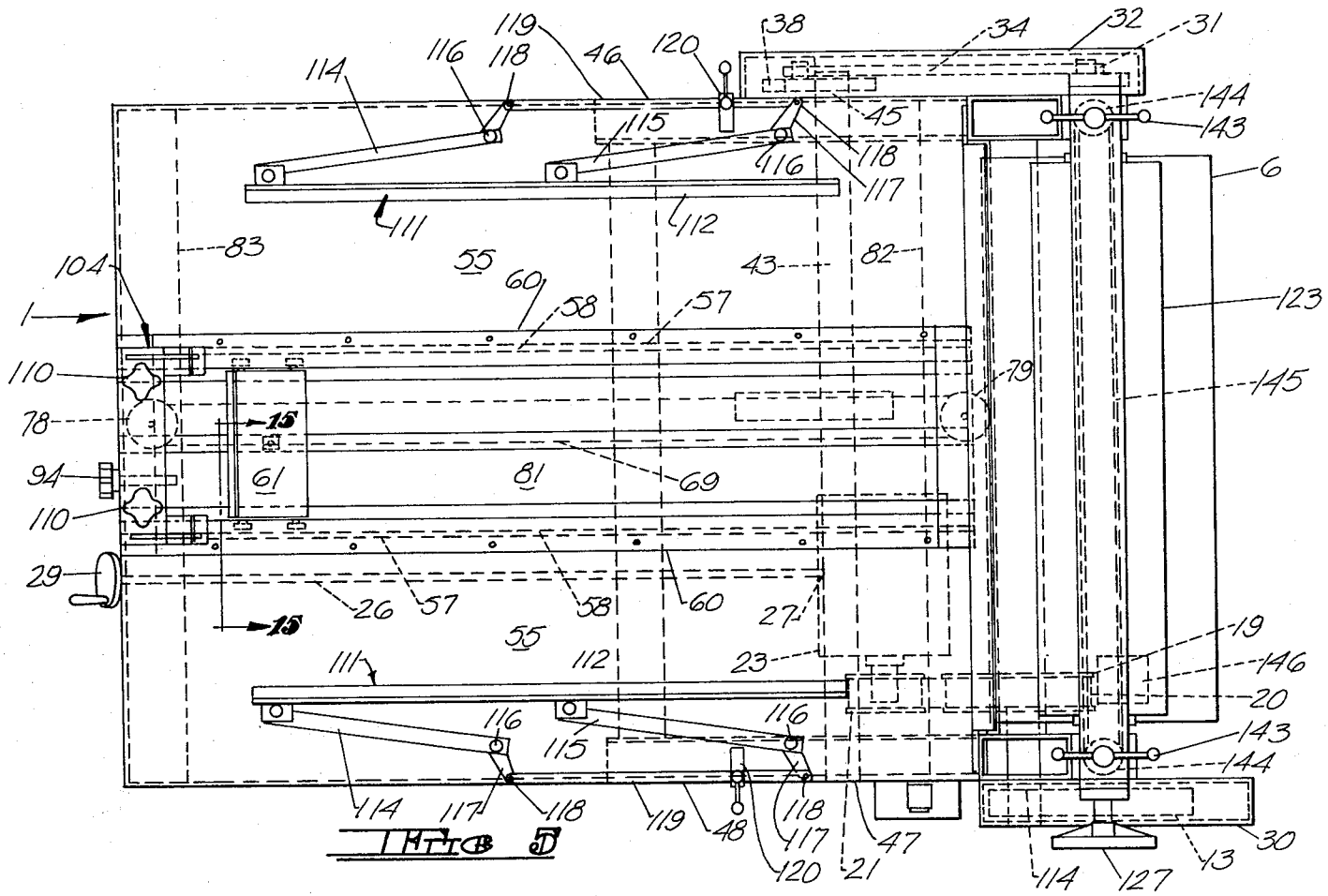
FIG. 5 is a top plan view of the rotary die cutting machine of the present invention.

As best shown in FIG. 5 and FIG. 6, one end of cable 69 is attached to the forwardmost edge of rocker arm plate 54 as at 77. Cable 69 passes tangentially to the uppermost surface of rocker arm plate 54 rearwardly and around rotatable sheave 78 located at the rearmost end of opening 56. Cable 69 then passes forwardly through clamp block 70 and around rotatable sheave 79 located at the forward end of opening 56. After passing around sheave 79, cable 69 passes tangentially over the surface of rocker arm plate 54, and is secured to the rearmost edge thereof by a threaded turnbuckle or the like 80 which can be used to adjust the tension of cable 69 as required.

It will be observed that when rocker arm plate 54 is pivoted to its forwardmost extreme corresponding to the position indicated by dashed line 51 for crank 38, pusher carriage 61 will be pulled to its rearmost position. As rocker arm plate pivots rearwardly, pusher carriage 61 is pulled to its forwardmost position corresponding to the position indicated by dashed line 52 for crank 38. In this manner, pusher carriage 61 shuttle back and forth between a rearmost and forwardmost position in synchronism with the rotation of die cutting roll 6.

Figure 7:
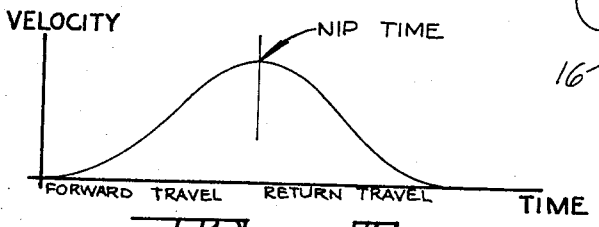
FIG. 7 is a graphical illustration of the velocity profile of the rotary die cutting machine pusher.

As explained hereinabove, shaft 43, and consequently rocker arm plate 54, do not move with a constant velocity throughout their arcs of travel. This same velocity profile is imparted to the motion of pusher carriage 61 as illustrated graphically in FIG. 7. Additionally, pusher 61 bearing a blank in the manner to be described, travels in a forward direction from its rearmost position at a relatively low velocity. This velocity increases, reaching a peak at approximately the same time as the forward edge of the material blank enters the roller nip. The lengths and relative positions of crank 31, pitman 34 and crank 38, as well as the locations of these members within adjustment slots 36 and 41 are such that the velocity of the material blank at the nip time matches the peripheral speed of the die cutting roll. In this manner, the material blank is not subjected to rapid acceleration forces which might cause buckling or the like, and in addition the material blank is passed smoothly from the pusher to the die cutting roll without differences in velocity which might cause tearing of the blank. As pusher carriage 61 returns to its rearmost position, its velocity decreases to a minimum value, permitting the next material blank to drop smoothly into place as will be described hereinafter.

A pusher adjustment plate, shown generally at 81, is positioned beneath pusher carriage 61 within opening 56, and is slidingly supported at its forward end by beam 82. The rearward portion of adjustment plate 81 is slidingly supported by a similar beam 83. Beams 82 and 83 are supported at their respective ends by vertical support plates 46 and 48, and also serve to provide structural rigidity to machine 1. Adjustment plate 81 comprises a pair of spaced horizontal outwardly extending flanges 84 which underlie guide block 58 and guide wheels 66. It will be observed that flange 84 is spaced slightly from downwardly depending flange 57 so as to be slidable therealong. Flange 84 terminates at its inner end in a vertical web member 85, flange and web 85 defining a channel in which wheels 65 and 66 are free to move. The upper end of web 85 is attached to a horizontally extending plate 86 which terminates in a downwardly depending flange 87. Flanges 87 are connected by a horizontally disposed plate 88, such that there is formed a channel 89 for providing clearance for movement of clamp block 70 of pusher carriage 61.

Figure 12:
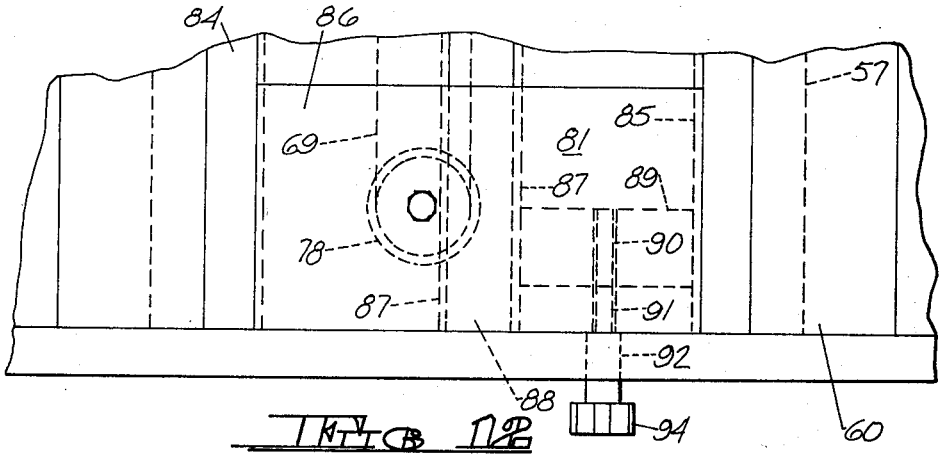
FIG. 12 is a fragmentary enlarged top plan view of the pusher support plate adjustment.

Forward cable sheave 79 is secured to the underside of plate 86 near the forward edge of pusher adjust plate 81 such that the portion of cable 69 attached to pusher carriage 61 lies within the channel created by flanges 87 and plate 88, and the portions of cable 69 attached to rocker arm plate 54 lie beneath plate 86. The rear cable sheave 78 is similarly affixed to plate 86 near the rearmost edge of pusher adjust plate 61. As a result of this construction, pusher carriage 61 can be adjusted slightly forward or backward by merely sliding adjustment plate 81 in the same direction. Means to accomplish movement of plate 81 are illustrated in detail in FIG. 12 and comprise a block 89 rigidly secured between web 85 and flange 87 near the edge of adjustment plate 81. Block 89 contains a threaded aperture 90 which threadadly engages threaded shaft 91 connected at its rear end to shaft 92, which is rotatably supported in strut 93 extending upwardly from rear support beam 83. The rear end of shaft 92 terminates in handle 94. Consequently, when handle 94 is rotated, adjustment plate 81 is moved forwardly or rearwardly, causing a corresponding change in the position of pusher carriage 61. This sensitive adjustment, which can be performed while the machine is operating, permits accurate registration of the forward edge of the material blank with the beginning of the die pattern located on roller 6.

Pusher carriage 61 pivotally supports pusher plate 95 which successively urges individual blanks toward the roller nip. Pusher plate 95 comprises a generally trapezoidal member 96 having a downwardly extending lip 97 at its narrow forward end which overhangs the forward edge of pusher carriage truck 62, so that pusher plate 95 makes an angle of approximately 30° with respect to carriage truck 62. Lip 97 contains a central aperature 98 and is urged against the forward edge of carriage truck 62 by means of spring 99 which is held in place by headed fastener 100 which passes through aperture 98 into a threaded block or the like attached to the underside of truck 62 near its forward edge. This construction permits pusher plate 95 not only to pivot vertically in order to maintain an upward pressure against the lowermost blank in the stack of blanks, but also to pivot from side-to-side in order to compensate for unevenness in the blank material such as might be caused by warping, etc. In cases of severely warped blanks, the width of lip 97 can be decreased to provide greater pivoting action for plate 95 as required. As best shown in FIG. 10, an aperture 101 is provided in the central portion of plate 95 in order to gain access to aperture 76 in truck 62 for loosening or tightening cable clamp 70. An upstanding lip 102 extends completely across the rearmost edge of plate 95, and serves to catch the rearmost edge of the bottom blank to push the blank toward the cutting roll. It will be observed that the forward edge 103 of lip 102 contains a recessed bevel which serves to prevent crushing of the rear edge of the blank.

Figure 13:
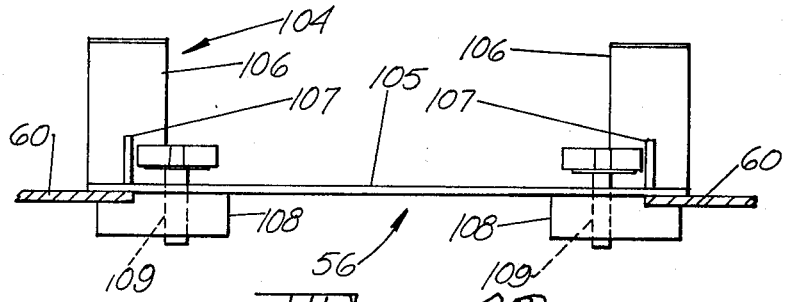
FIG. 13 is a fragmentary enlarged rear elevation view, partially in cross section, of the material blank back stop.

FIG. 13 illustrates the blank backstop, shown generally at 104, which provides a positioning surface for the rear edges of the blanks. Backstop 104 comprises a flat plate 105 spanning opening 56 and slidingly abutted along its outermost edges by plates 60. Plate 105 contains a pair of spaced upstanding arms 106 which are strengthened by buttresses 107, and are inclined slightly rearwardly in order to accommodate the rear edges of material blanks B. Backstop 104 may be moved to any position along opening 56 to accommodate different lengths of blanks by loosening clamp blocks 108 which squeeze together plates 60 and plate 105 by means of threaded fasteners 109. Clamp blocks 108 may be loosened or tightened as required by rotating handles 110 connected to threaded fasteners 109 in the appropriate direction.

Registration of the material blanks in a direction transverse to their direction of travel is accomplished by means of pantograph-like side guides shown generally at 111. The operation of each side guide is the same, with the only difference being that the structural parts are reversed to provide for right-hand and left-hand operation. Each side guide comprises a plate-like platen 112 extending parallel to the direction of feed of the machine. The upper edge 113 of each platen is inclined outwardly to facilitate placing material blanks between the side guides. Identical hinged arms 114 and 115 are pivotally attached to the outer surface of platen 112 near its rear edge and center, respectively. Each arm is pivotally connected to surface 55 of machine 1 as at 116. An outwardly extending arm 117 is fixedly attached to the end of each arm adjacent pivot point 116, and terminates in pivot pins 118, which are connected by link bar 119. With this construction, it will be observed that as platen 112 is moved inwardly or outwardly to accommodate blanks of varying widths, the inside surface of platen 112 remains parallel to the direction of travel of the blanks, in order to provide an accurately positioned guide surface. Side guides 111 may be held in position by means of lock 120 which clamps link bar 119 between a pair of jaws, one of which is affixed to surface 55.

A vertical fence or gate 121 is provided at the forward end of the feed station, adjacent the nip, and contains a forwardly inclined portion 122 permitting blanks passing along surface 55 to pass therebeneath. For purposes of an exemplary showing, it has been found that providing inclined portion 122 with a pinch of approximately 27°-30° eliminates many problems previously experienced with blank jams. Fence 121 may extend completely across the width of the machine, or may be provided only at the central portion of the nip area in order to properly guide the feeding of blanks.

Anvil or back-up roll 123 is rotatably mounted overlying die cutting roll 6 and is of cylindrical shape, and of smaller diameter than die cutting roll 6. The outer surface of roll 123 may also be covered with a mat 124 of resilient material such as polyurethane or the like in order to provide a resilient surface for rule-like dies 11 to work against. In normal operation, back-up roll 123 will be adjusted vertically so that the outermost edges of dies 10 protrude slightly into the resilient surface of mat 124. In this manner, roll 123 may be made free-wheeling and is driven by contact with roll 6, thus eliminating registration problems which might otherwise occur if roll 123 were separately powered.

Figure 14:
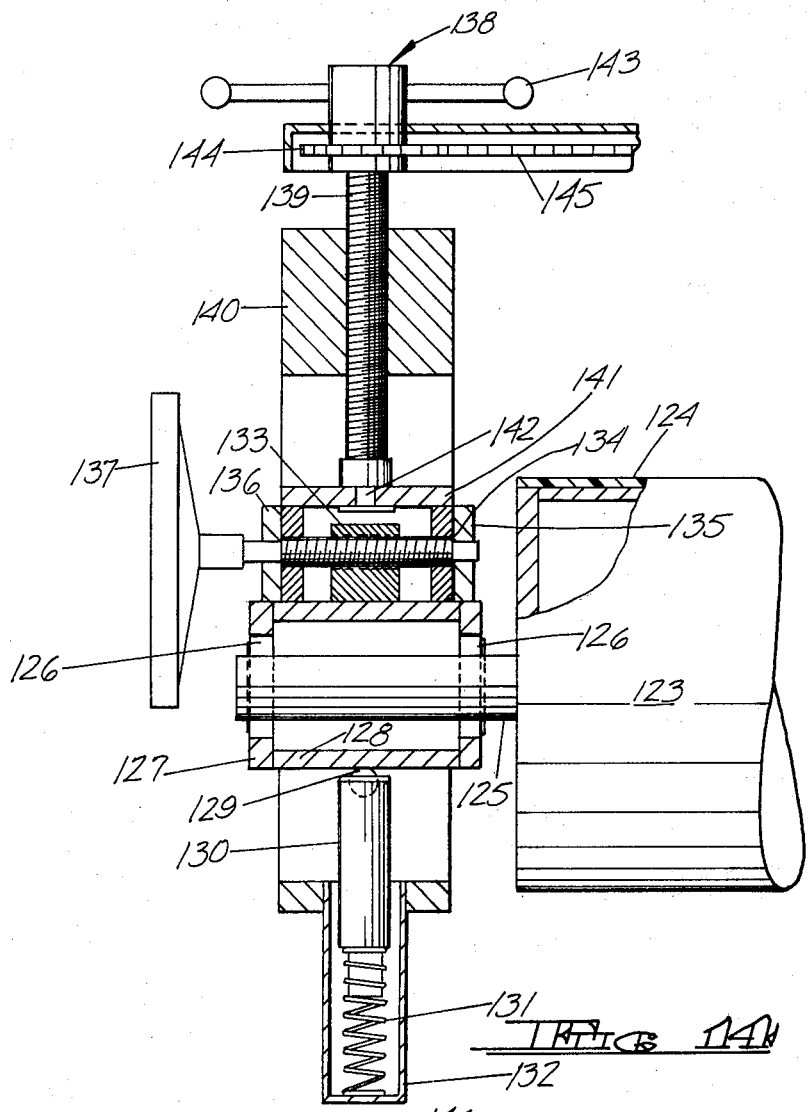
FIG. 14 is a fragmentary enlarged side elevation view, partially in cross section, of the vertical and horizontal adjustment features of the back-up roll of the present invention.

As best shown in FIG. 14, shaft 125 of roll 123 is journaled at each end in a pair of spaced bearings 126. Bearings 126 are fixed in position in the ends of bearing block 127. Bearing block 127 is slidingly supported at its lower surface 128 by roller bearing 129 rotatably received in the upper planar surface of piston-like support cylinder 130. Cylinder 130 is urged upwardly by compression spring 131, the lower end of which bears against the inner surface of cylinder housing 132. It will be understood that this construction permits back-up roll 124 and bearing block 127 to move parallel to the axis of rotation of roll 123.

A threaded block 133 has its lowermost surface rigidly attached to the upper surface of bearing block 127, and threadedly engages shaft 134 which is rotatably journaled at either end to inner and outer thrust plates 135 and 136, respectively. A hand wheel 137 is attached to the outer end of rod 34. As a result of this construction, as hand wheel 137 is rotated, threaded block 133 is forced along threaded rod 134, causing bearing block 127 and back-up roll 123 to move axially. As described hereinabove, this adjustment permits wear impressions caused by dies 11 impressed on the outer surface of mat 124 to be evenly distributed over the surface of the back-up roll. The adjustment may be made while machine 1 is in operation, eliminating delays caused by machine downtime.

The parallel pressure downfeed adjustment, shown generally at 138, permits vertical positioning of back-up roll 123 in order to vary the amount of pressure applied between dies 11 and back-up roll 123. The parallel pressure downfeed adjustment 138 comprises vertical threaded shaft 139 threadedly engaged in block 140, with the lower end of shaft 139 rotatably secured to bearing plate 141 as at 142. Crank arm 143 attached to the upper end of shaft 139 permits rotating the shaft in the desired direction. The upper end of shaft 39 is also attached to a sprocket wheel 144 which engages a linked chain 145 for driving a similarly constructed parallel pressure downfeed adjustment 138 located on the opposite end of machine 1. In operation, rotating crank 143 in one direction causes threaded shaft 139 to move downwardly and apply a downward pressure against bearing block 127, which causes back-up roll 123 to move downwardly against the upward pressure of compression spring 131. If less pressure is desired between back-up roll 123 and die cutting roll 6, crank 143 may be rotated in the opposite direction thereby causing bearing plate 141 to move upwardly and releasing the downward pressure on bearing block 127. As pressure is released from bearing block 127, compression spring 131 urges cylinder 130 and consequently bearing block 127 in an upward direction to cause back-up roll 123 to also move upwardly. It will be understood that the vertical and horizontal adjustments located on the opposite end of machine 1 are constructed and operate in an identical manner, except that block 133, threaded shaft 134 and hand wheel 137 are not utilized. It will be further understood that linked chain 145 engages a similar sprocket wheel 144 on the opposite end of the machine which causes a corresponding upwardly or downwardly movement to occur in back-up roll 123. In this manner, equal pressures are applied to both ends of the back-up roll to maintain a uniform pressure across the surface of die cutting roll 6.

Figure 16:
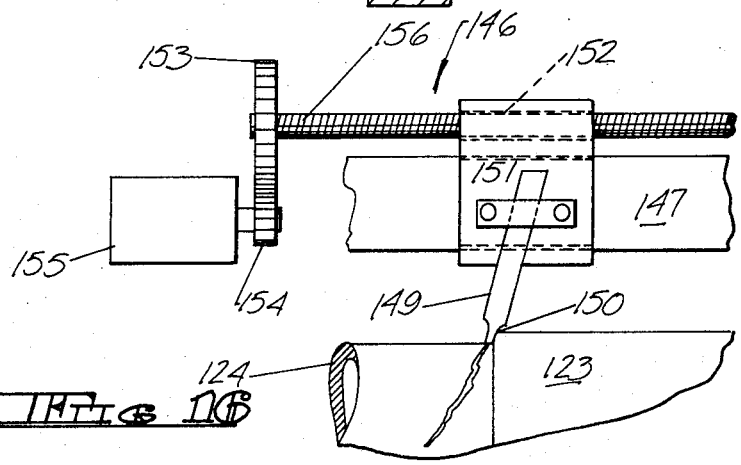
FIG. 16 is an enlarged front elevation view of cutter stripper 146.

FIG. 16 illustrates cutter stripper 146 which is designed to remove a small portion of the resilient mat 124 of back-up roll 123 when the mat is no longer usable because of excessive wear. Cutter stripper 146 comprises a rectangular-shaped support bar 147 which is supported above and parallel to back-up roll 123. A block-like carriage 148 contains a rectangular-shaped aperature which engages support bar 147 such that block 148 is free to slide therealong. A cutting tool 149 is attached to the front surface of block 149, and contains a suitable cutting edge 150 designed to produce the proper stripping of resilient mat 124. Tool 149 may be adjusted vertically by clamp plate 151 to remove the proper amount of mat 124.

Cutter stripper block 148 is moved along support bar 147 by means of lead screw 156 which engages a threaded aperature 152 extending longitudinally through the upper portion of block 148. A spur gear 153 is connected to one end of lead screw 156 and is driven from a similar gear 154 attached to electric motor 155, such that the entire lead screw 156 may be rotated thus serving to propel block 148 and attached tool 149 in a direction parallel to the axis of rotation of back-up roll 123. In operation, roll 123 would normally be rotated to produce the desired stripping of the surface of mat 124. When the stripping operation is completed, block 148 may be returned to the position shown in FIG. 3 either by automatic means (not shown) or manually.

It will be understood that various changes in the details, materials, steps and arrangements of parts, which have been herein described and illustrated in order to explain the nature of the invention, may be made by those skilled in the art within the principal and scope of the invention as expressed in the appended claims.

The embodiments of the invention in which an exclusive property or privilege is claimed are as follows:

1. A rotary die cutting and scoring machine having a rotatably mounted cylindrical die cutting roll including die means affixed to the outer surface of said roll, means for rotating said roll, a free wheeling rotatably mounted cylindrical anvil roll having a resilient outer surface overlying said cutting roll, the outer surfaces of said rolls making rolling contact for rotating said anvil roll in a direction opposite to the direction of rotation of said cutting roll, a horizontal planar table-like surface positioned adjacent said rolls for supporting a stack of sheets in order to feed the bottommost of said sheets between said rolls, a pusher for feeding said bottommost sheet, guide means attached to said table-like surface mounting said pusher for reciprocating movement in synchronism with the rotation of said cutting roll along said table-like surface parallel to the direction of sheet feed between a first position wherein said bottommost sheet is engaged by said pusher and a second position wherein the leading edge of said sheet is fed between said rolls, said guide means comprising a pair of spaced rail-like tracks extending along and attached to said table-like surface parallel to the direction of feed, said pusher comprising a horizontal plate-like truck including a first set of wheels rotatably supported on horizontal axles extending outwardly from the sides of said truck and a second set of wheels rotatably supported on vertical axles extending downwardly from said truck, said first set of wheels making rolling contact with the upper surfaces of said rails, said second set of wheels making rolling contact with the inside surfaces of said rails, said pusher mounting a plate-like support hingedly and pivotally attached to the leading edge of said truck and extending upwardly and rearwardly therefrom, said plate-like support being urged upwardly against the lower surface of said bottommost sheet and including a transversely extending raised lip configured to abut the rear edge of said sheet, means for reciprocating said pusher between said first and second positions such that said pusher moves away from said first position with a relatively slow initial velocity but accelerates such that the velocity of the leading edge of said sheet substantially matches the peripheral speed of said cutting roll as said leading edge is fed between said rolls, said reciprocating means comprising a first crank arm having one end non-rotatably attached to said cutting roll for rotation therewith, a pitman having one end rotatably attached to said first crank arm and the other end pivotally attached to a second crank arm, a rotatable shaft non-rotatably secured to one end of said second crank arm extending beneath and transverse to said table-like surface, adjustment means associated with at least one of said crank arms for changing the movement of said pusher, an upstanding rocker arm connected to said shaft terminating at its upper end in a downwardly concave arcuate plaste, said rocket arm being imparted with a rocking motion in synchronism with the rotation of said cutter roll, a cable having one end secured to the forward edge of said arcuate plate and extending rearwardly in a direction parallel to said direction of feed, first sheave means rotatably attached adjacent the rear part of said table-like surface, said cable passing around said first sheave means and continuing in a forward direction, second sheave means rotatably attached adjacent the forward part of said table-like surface, said cable passing around said second sheave means and continuing in a rearward direction, the opposite end of said cable being secured to the rear edge of said arcuate plate, means for attaching said pusher to said cable between said sheave means, means for providing adjustment of the location of said forward position of said pusher with respect to the angular position of said cutting roll in order to correctly register the position of said die means with respect to the leading edge of said sheet, said adjustment means comprising a plate-like support underlying said pusher and mounted for movement with respect to said table-like surface in directions parallel to said direction of feed means for moving said plate-like support a desired distance, said sheave means being rotatably attached to the forward and rearward ends of said plate-like support, respectively, means for positioning and guiding the side edges of said blanks comprising a pair of spaced plate-like side guides extending parallel to said direction of feed and a pantograph-like operating mechanism, the inner surfaces of said side guides being configured to abut the side edges of said sheets, each of said guides being independently movable in a direction transverse to said direction of feed so that said inner surface remains parallel to said direction of feed throughout the range of movement of said guide, said operating mechanism comprising a pair of arms each having one end pivotally attached at spaced locations to the outer surface of said guide, each arm having its distal end pivotally attached to said table-like surface and terminating in an outwardly extending member, a connecting link pivotally connecting the outermost ends of said members, a clamp affixed to said table-like surface for restraining movement of said link to lock said guide in a desired position, and means for removing a selected portion of said resilient material to produce a relatively smooth outer surface on said roll comprising a cutting tool mounted to contact said resilient surface and means for moving said tool in a direction parallel to the direction of rotation of said anvil roll.

2. A rotary die cutting and scoring machine having a rotatably mounted cylindrical die cutting roll including die means affixed to the outer surface of said roll, means for rotating said roll, a rotatably mounted cylindrical anvil roll having a resilient outer surface vertically mounted from said cutting roll, means positioned adjacent said rolls for supporting a stack of sheets in order to feed the bottommost of said sheets between said rolls, a pusher for feeding said bottommost sheet, guide means mounting said pusher for reciprocating movement in synchronism with the rotation of said cutting roll parallel to the direction of sheet feed between a first position wherein said bottommost sheet is engaged by said pusher and a second position wherein the leading edge of said sheet is fed between said rolls, means for reciprocating said pusher between said first and second positions such that said pusher moves away from said first position with a relatively slow initial velocity but accelerates such that the velocity of the leading edge of said sheet substantially matches the peripheral speed of said cutting roll as said leading edge is fed between said rolls, means for providing adjustment of the location of said forward position of said pusher with respect to the annular position of said cutting roll in order to correctly register the position of said die means with respect to the leading edge of said sheet, means for positioning and guiding the side edges of said sheets comprising a pair of spaced plate-like side guides extending parallel to said direction of feed, the inner surfaces of said side guides being configured to abut the side edges of said sheets, each of said guides being movable in a direction transverse to said direction of feed so that said inner surface remains parallel to said direction of feed throughout the range of movement of said guide, and means for removing a selected portion of said resilient material to produce a relatively smooth outer surface on said anvil roll.

3. A rotary die cutting and scoring machine having a rotatably mounted cylindrical die cutting roll including die means affixed to the outer surface of said roll, means for rotating said roll, a rotatably mounted cylindrical anvil roll vertically mounted from said cutting roll, means positioned adjacent said rolls for supporting a stack of sheets in order to feed the bottommost of said sheets between said rolls, a pusher for feeding said bottommost sheet, said pusher being mounted for reciprocating movement parallel to the direction of sheet feed between a first position wherein said bottommost sheet is engaged by said pusher and a second position wherein the leading edge of said sheet is fed between said rolls, and means for reciprocating said pusher between said first and second positions in synchronism with the rotation of said cutting roll, wherein said reciprocating means comprises a rotatable shaft, an upstanding rocker arm connected to said shaft, said rocker arm terminating at its upper end in a downwardly concave arcuate plate, means connecting said shaft to said cutting roll for producing a rocking motion in said shaft synchronous with the rotation of said cutting roll, a cable having one end secured to the forward edge of said arcuate plate and extending rearwardly in a direction parallel to said feed direction, first sheave means rotatably attached adjacent said first position, said cable passing around said first sheave means and continuing in a forward direction, second sheave means rotatably attached adjacent said second position, said cable passing around said second sheave means and continuing in a rearward direction, the opposite end of said cable being secured to the rear edge of said arcuate plate, and means for attaching said pusher to said cable between said sheaves.

4. The machine according to claim 3 wherein said connecting means comprises a first crank arm having one end non-rotatably attached to said cutting roll for rotation therewith, a second crank arm having one end non-rotatably attached to said shaft for rotation therewith, and a pitman having one end rotatably connected to said first crank arm and the other end pivotally connected to said second crank arm.

5. The machine according to claim 4 wherein said crank arms and said pitman are dimensioned and arranged such that the velocity of said pusher increases as said pusher moves said sheet toward said second position such that the velocity of said leading edge of said sheet substantially matches the the peripheral speed of said cutting roll as the leading edge of said sheet is fed between said rolls.

6. The machine according to claim 4 wherein one at least of said crank arms contains adjustment means for changing the movement of said pusher.

7. A rotary die cutting and scoring machine having a rotatably mounted cylindrical die cutting roll including die means affixed to the outer surface of said roll, means for rotating said roll, a rotatably mounted cylindrical anvil roll vertically mounted from said cutting roll, means positioned adjacent said rolls for supporting a stack of sheets in order to feed the bottommost of said sheets between said rolls, a pusher for feeding said bottommost sheet, means mounting said pusher for reciprocating movement in synchronism with the rotation of said cutting roll parallel to the direction of feed between a first position wherein said bottommost sheet is engaged by said pusher and a second position wherein the leading edge of said sheet is fed between said rolls, means for reciprocating said pusher between said first and second positions, and means including a stationary adjustment handle for providing adjustment of the location of said forward position of said pusher with respect to the angular position of said cutting roll in order to correctly register the position of said die means with respect to the leading edge of said sheet while the pusher is reciprocating between said first and second positions.

8. The machine according to claim 7 wherein said adjustment means comprises a plate-like support underlying said pusher and mounted for movement in directions parallel to said direction of feed and means for moving said plate-like support a desired distance, said reciprocating means including sheave means rotatably attached to the forward and rearward ends of said plate-like support, respectively, a cable passing around said sheave means, means for attaching said pusher to said cable between said sheave means, and means for alternately pulling each end of said cable to affect said reciprocating motion in said pusher.

9. A rotary die cutting and scoring machine having a rotatably mounted cylindrical die cutting roll including die means affixed to the outer surface of said roll, means for rotating said roll, a rotatably mounted cylindrical anvil roll vertically mounted from said cutting roll, means positioned adjacent said rolls for supporting a stack of sheets in order to feed the bottommost of said sheets between said rolls, a pusher for feeding said bottommost sheet, means for guiding said pusher for reciprocating movement along said table-like surface in the direction of sheet feed between a first position wherein said bottommost sheet is engaged by said pusher and a second position wherein the leading edge of said sheet is fed between said rolls, and means for reciprocating said pusher between said first and second positions in synchronism with the rotation of said cutting roll, said pusher comprising a horizontal plate-like truck, and means located on said truck for supporting and feeding said bottommost sheet, said pusher guiding means comprising a pair of spaced rail-like tracks extending parallel to the direction of feed, said truck including a first set of wheels rotatably supported on horizontal axles extending outwardly from the sides of said truck, said wheels making rolling contact with the upper surfaces of said rails, and a second set of wheels rotatably supported on vertical axles extending downwardly from said truck, said second set of wheels making rolling contact with the inside surfaces of said rails.

10. A rotary die cutting and scoring machine having a rotatably mounted cylindrical die cutting roll including die means affixed to the outer surface of said roll, means for rotating said roll, a rotatably mounted cylindrical anvil roll vertically mounted from said cutting roll, means positioned adjacent said rolls for supporting a stack of sheets in order to feed the bottommost of said sheets between said rolls, a pusher for feeding said bottommost sheet, said pusher being mounted for reciprocating movement parallel to the direction of sheet feed between a first position wherein said bottommost sheet is engaged by said pusher and a second position wherein the leading edge of said sheet is fed between said rolls, and means for reciprocating said pusher between said first and second positions in synchronism with the rotation of said cutting roll, said pusher comprising a horizontal plate-like truck and means located on said truck for supporting and feeding said bottommost blank, said supporting and feeding means comprising a plate-like support hingedly attached to the leading edge of said truck and extending upwardly and rearwardly from the leading edge of said truck, said plate-like support being urged upwardly against the lower surface of said bottommost sheet and including means for grasping said sheet.

11. The machine according to claim 10 wherein said plate-like support is pivotally attached to the leading edge of said truck.

12. The machine according to claim 10 wherein said grasping means comprises an upstanding lip extending across the rear edge of said plate-like support configured to abut the rear edge of said sheet.

13. The machine according to claim 12 wherein the forward edge of said lip slopes downwardly and rearwardly.

14. A rotary die cutting and scoring machine having a rotatably mounted cylindrical die cutting roll including die means affixed to the outer surface of said roll, means for rotating said roll, a rotatably mounted cylindrical anvil roll vertically mounted from said cutting roll, means positioned adjacent said rolls for supporting a stack of sheets in order to feed the bottommost of said sheets between said rolls, a pusher for feeding said bottommost sheet, said pusher being mounted for reciprocating movement parallel to the direction of sheet feed between a first position wherein said bottommost sheet is engaged by said pusher and a second position wherein the leading edge of said sheet is fed between said rolls, and means for reciprocating said pusher between said first and second positions in synchronism with the rotation of said cutting roll, wherein the outer surface at least of said anvil roll comprises a resilient material, said machine further including means for removing a selected portion of said resilient material to produce a relatively smooth outer surface on said anvil roll.

15. The machine according to claim 14 wherein said removing means comprises a cutting tool mounted to contact said resilient surface and means for moving said tool in a direction parallel to the direction of rotation of said anvil roll.

* * * * *